US009700900B1

(12) United States Patent
Olivier

(10) Patent No.: US 9,700,900 B1
(45) Date of Patent: Jul. 11, 2017

(54) COUNTER-FLOW ORE SEPARATOR

(71) Applicant: Black Shell Technologies LLC, Vero Beach, FL (US)

(72) Inventor: Laurent R. Olivier, Vero Beach, FL (US)

(73) Assignee: Black Shell Technologies LLC, Vero Beach, FL (US)

( * ) Notice: Subject to any disclaimer, the term of this patent is extended or adjusted under 35 U.S.C. 154(b) by 0 days.

(21) Appl. No.: 14/859,562

(22) Filed: Sep. 21, 2015

Related U.S. Application Data

(60) Provisional application No. 62/053,269, filed on Sep. 22, 2014.

(51) Int. Cl.

| | |
|---|---|
| ***B07B 9/00*** | (2006.01) |
| ***B04C 9/00*** | (2006.01) |
| ***B04C 5/103*** | (2006.01) |
| ***B03B 7/00*** | (2006.01) |
| ***B04C 5/26*** | (2006.01) |

(52) U.S. Cl.
CPC ..... *B04C 9/00* (2013.01); *B03B 7/00* (2013.01); *B04C 5/103* (2013.01); *B04C 5/26* (2013.01); *B04C 2009/002* (2013.01)

(58) Field of Classification Search
CPC .. B04C 9/00; B04C 5/26; B04C 5/103; B03B 7/00
USPC ..... 209/13, 17, 18, 12.1, 20, 132, 142, 644, 209/710
See application file for complete search history.

(56) References Cited

U.S. PATENT DOCUMENTS

| | | | | | |
|---|---|---|---|---|---|
| 2,135,957 | A * | 11/1938 | Wuensch | B03B 13/005 | 209/172.5 |
| 2,599,402 | A * | 6/1952 | Lindsey | B03B 5/56 | 209/270 |
| 3,590,558 | A * | 7/1971 | Fernandes | B04C 5/103 | 55/338 |
| 4,119,534 | A * | 10/1978 | Porter | B07B 1/22 | 209/291 |
| 4,267,980 | A * | 5/1981 | LaPoint | B03B 5/42 | 209/17 |
| 5,302,289 | A * | 4/1994 | McClung | B01D 21/0018 | 210/519 |
| 5,507,396 | A * | 4/1996 | Hauch | B07B 1/18 | 209/290 |
| 6,938,780 | B2 * | 9/2005 | Baglione | B04C 5/081 | 209/717 |
| 7,413,084 | B2 * | 8/2008 | Wegner | B03B 5/32 | 209/139.1 |

(Continued)

*Primary Examiner* — Terrell Matthews
(74) *Attorney, Agent, or Firm* — Nicholas Pfeifer Smith & Hopen, P. A.

(57) ABSTRACT

The present invention includes a mining system adapted to change underwater mining by selecting and harvesting only the target ore or gem. It eliminates costly displacement in mass of ore or material to the surface or shore, reduces pollution of the water column, and minimizes disturbance of the environment. The system includes a trommel fluidly coupled to separators, wherein each separator uses a vortex-like flow pattern to separate high-density sediment from lower density sediment based on flow rate. The present invention is the capable of separating and collecting various sized of desired ore in one pass. Additionally, the system is adapted to be coupled with a ROV dredge to reduce or eliminate diving time and risk of human life.

11 Claims, 12 Drawing Sheets

(56) References Cited

U.S. PATENT DOCUMENTS 8,875,903 B2 * 11/2014 Lean ..... B01D 45/12
209/712

* cited by examiner

COUNTER-FLOW ORE SEPARATOR

CROSS-REFERENCE TO RELATED APPLICATIONS

This nonprovisional application claims priority to provisional application No. 62/053,269, entitled "COUNTER-FLOW ORE SEPARATOR," filed Sep. 22, 2014 by the same inventor.

BACKGROUND OF THE INVENTION

1. Field of the Invention

This invention relates, generally, to mining devices. More specifically, it relates to a mining device using a counter-flow system to separate sand and ore.

2. Brief Description of the Prior Art

Placer deposits are accumulations of resistant and insoluble minerals that have been eroded from their original locations of formation and deposited along river courses or at the ocean margins. The most important of these deposits contain gold, platinum, tin, titanium, chromite, and diamonds. Today, much of the world's tin and many of the gem diamonds are recovered by dredging near-shore ocean sediments for minerals that were carried into the sea by rivers. Gold has been recovered in the past from such deposits, most notably in Nome, Ak. Large quantities of placer titanium minerals occur in beach and near-shore sediments, but mining today is confined generally to the beaches or onshore Mining, especially underwater mining is more often than not coupled with extremely dangerous conditions, including but not limited to storms, freezing temperatures, frozen ocean, deep-water access, and lengthy and difficult ocean travels. Other issues often associated with current underwater mining techniques are pollution, travel time from port to mining site, extensive cleaning times, and the requirement of a diver in deep, dark, and cold mining locations. Conventional approaches include floating dredges, barge excavators, divers with suction hoses, and manual fine sorting. Floating systems only work in calm ice-free seas (6-10 weeks/year) and typical operation grosses roughly one million dollars in gold per season. A floating dredge is limited by depth, current, and weather, and requires an operator on the bottom, an operator on the top, and surface processing. Seabed dredges require surface processing. Surface excavators and bucket dredges are limited by depth and weather, lack maneuverability, have no visibility of the seafloor, and require surface processing. Each of the approaches is limited includes difficulties that limit the efficiency of the respective systems. A new system capable of operating for greater lengths of time in a safer and more efficient manner is necessary.

Accordingly, what is needed is an underwater mining system capable of operating by a remote control and adapted to continuously separate a desired ore from the surrounding sediment while re-depositing the undesired sediment without creating water column pollution. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a more efficient and effective mining system is now met by a new, useful, and nonobvious invention.

The novel structure includes a trommel fluidly coupled to a first separator for removing desired ore from a mixture of dredged material. The trommel includes a trommel inlet and a trommel outlet with a trommel screen disposed between the trommel inlet and trommel outlet. A trommel trough is located beneath the trommel for collecting material that filters through the trommel screen. The Trommel trough is fluidly coupled to a first separator through a first separator inlet. The material collected in the trommel trough funnels into the first separator inlet and enters an initial separation chamber having a fluid counter-flow. The fluid counter-flow imposes a force on the material funneled into the first separator, where the force is less than the weight of a desired ore and greater than the weight of surrounding sediment that is common in a location where the mining system is operating. The first separator is fluidly coupled to a first separator outlet such that the first separator outlet receives the surrounding sediment that is forced upwards by the fluid counter-flow to discharge the undesired sediment from the separator. The first separator includes a collection outlet located at its bottom end and fluidly coupled to the initial separation chamber. The collection outlet receives the desired ore that overcomes the force imposed by the fluid counter-flow.

In an embodiment, the trommel further includes a deflector cone located near the trommel inlet, such that a dredged mixture strikes the deflector cone after passage through the trommel inlet.

An embodiment includes the trommel screen having a first section and a second section, where the first section is near the trommel inlet and the second section is nearer the trommel outlet. The second section has greater porosity than the first section to allow larger material to filter through the second section than the first section. The trommel trough also includes a first section and a second section corresponding to the first and second sections of the trommel screen. The first separator is fluidly coupled to the first section of the trommel trough and a second separator is fluidly coupled to the second section of the trommel trough.

An embodiment includes the separators having a secondary separation chamber fluidly coupled to the initial separation chamber to receive any material that passes through the initial separation chamber. The secondary separation chamber is coupled to a vortex inlet that creates a vortex fluid flow in the secondary separation chamber. The vortex fluid flow imposes a force on any material in the secondary separation chamber to collect undesired sediment in the vortex fluid flow while allowing desired ore to escape the vortex fluid flow based on the weight of the desired ore and the weight of surrounding sediment. In an embodiment, the vortex inlet further includes a valve adapted to adjust flow rate.

An embodiment may include a plunger valve located at a bottom end of the secondary separation chamber. The plunger valve can transition between an open position and a closed position, where the open position allows the desired ore to pass into a final separation chamber fluidly coupled to the secondary separation chamber and the closed position prevents passage of the desired ore into the final separation chamber. The final separation chamber includes a bottom valve having an open position and a closed position. The bottom valve allows the desired ore to pass through the collection outlet when the bottom valve is in the open position and prevents the desired ore from passing through the collection outlet when the bottom valve is in the closed position.

In an embodiment, the plunger valve has a conical shape with a tip extending upwards into the secondary separation chamber.

An embodiment includes a grate between the initial separation chamber and the secondary separation chamber that is adapted to reduce the vortex fluid flow from the secondary separation chamber when the flow passes from the secondary separation chamber into the initial separation chamber.

An embodiment may employ a flush assembly fluidly connected to the final separation chamber with a valve between the flush assembly and the final separation chamber. The flush assembly is adapted to force sediment in the separator upwards and out of the separator outlet.

In an embodiment, a collection tube is fluidly coupled to the first and second separators.

An embodiment may also include a nugget trap near the trommel outlet. The nugget trap includes a floor opening leading to a gate valve. The gate valve is adapted to open upon detection of a nugget to secure the nugget in a nugget housing. The nugget trap includes a fluid inlet between the floor opening and the gate valve, adapted to create a vortex-like flow pattern to further separate the desired ore nuggets from any undesired sediment.

An embodiment includes a trommel valve located near or on the trommel outlet to adjust the flow rate through the trommel.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a system for underwater mining capable of working directly on the bottom or bed of a body of water, under ice if necessary, and by a remote control if desired to negate the need of a diver. The present invention separates the desired ore in a continuous manner and re-deposits the undesired sand directly on the spot without creating water column pollution. In a certain embodiment, the present invention is coupled with a 24/7 remote operating vehicle (ROV) dredge. The mining system separates the undesired material using specific density in a counter-flow system. Knowing that gold has a specific density roughly six times greater than surrounding sand, the system can be specifically calibrated to separate gold from the surrounding sand. The system may be calibrated, based on known specific densities, to separate and remove any ore from a surrounding substrate, so long as the desired ore has a different specific density than the material found in the surrounding substrate.

Example

Figure 1:
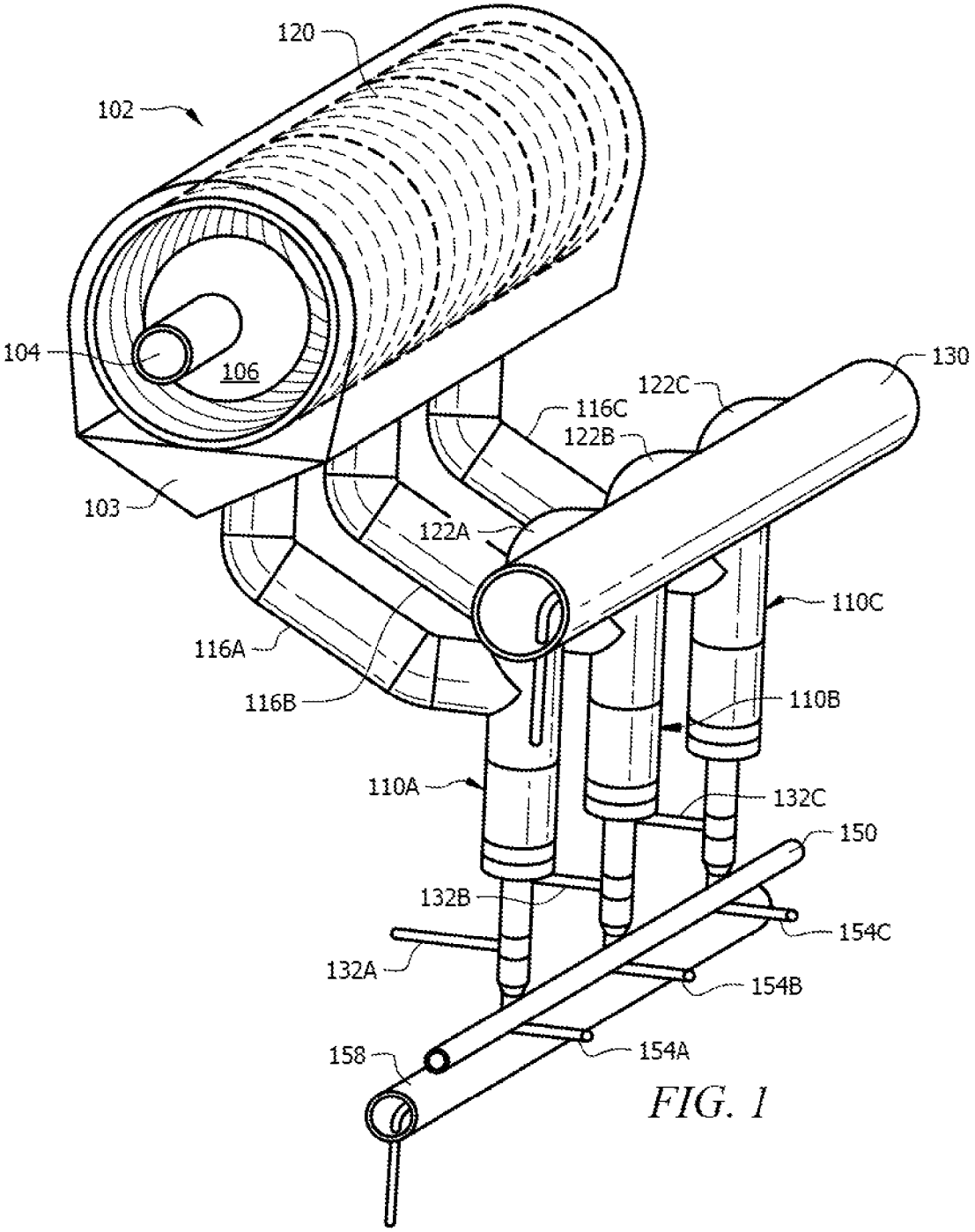
FIG. 1 is a perspective view of an embodiment of the present invention having three separators and a trommel for classification of sand/gravel before separation.
Figure 11:
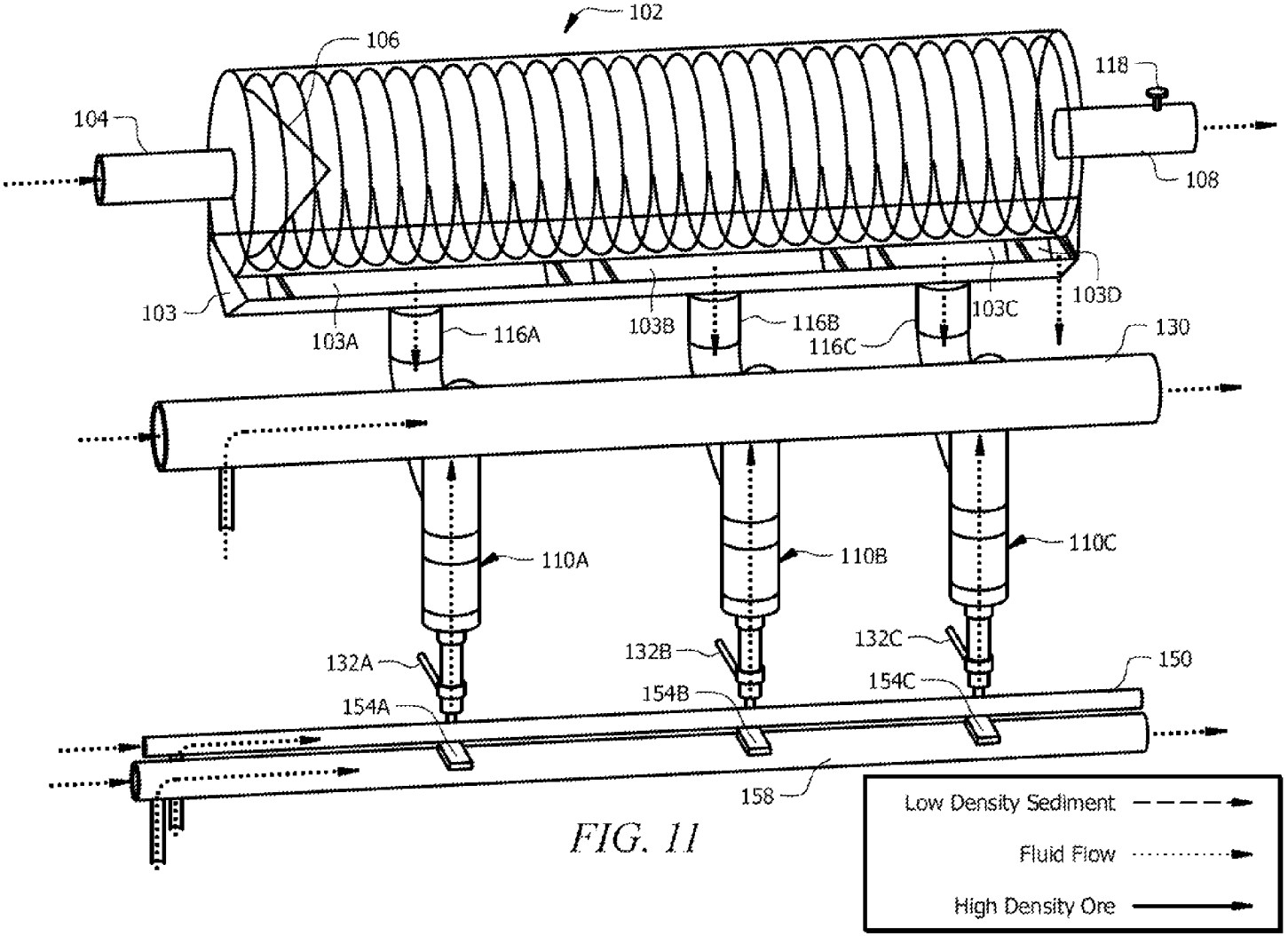
FIG. 11 is a perspective view of an embodiment of the present invention showing the water and jet flow direction in the system to move the collected material to different exits.
Figure 12B:
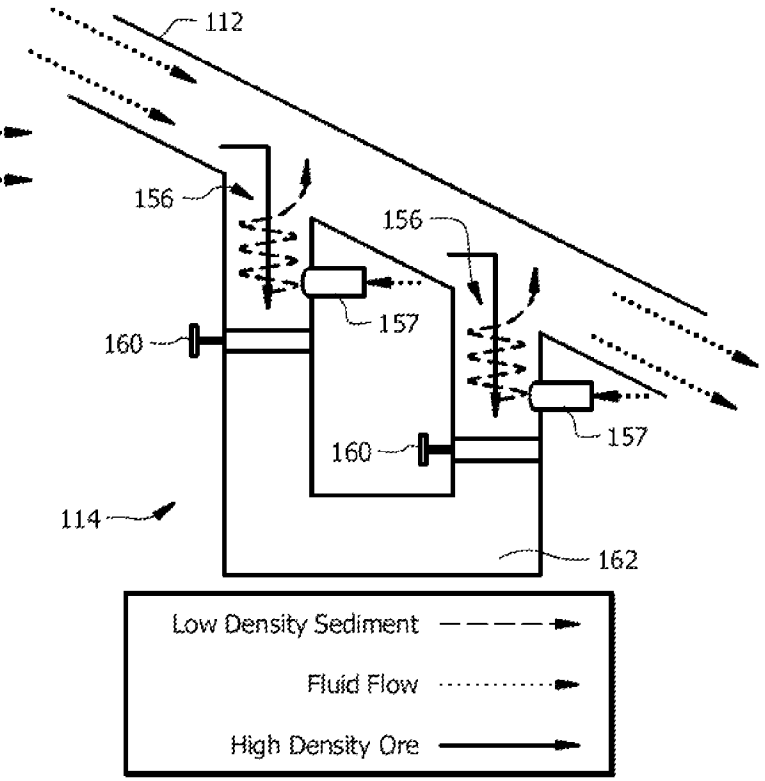
FIG. 12B provides another embodiment of the nugget trap where the trap is angled downward.
Figure 12A:
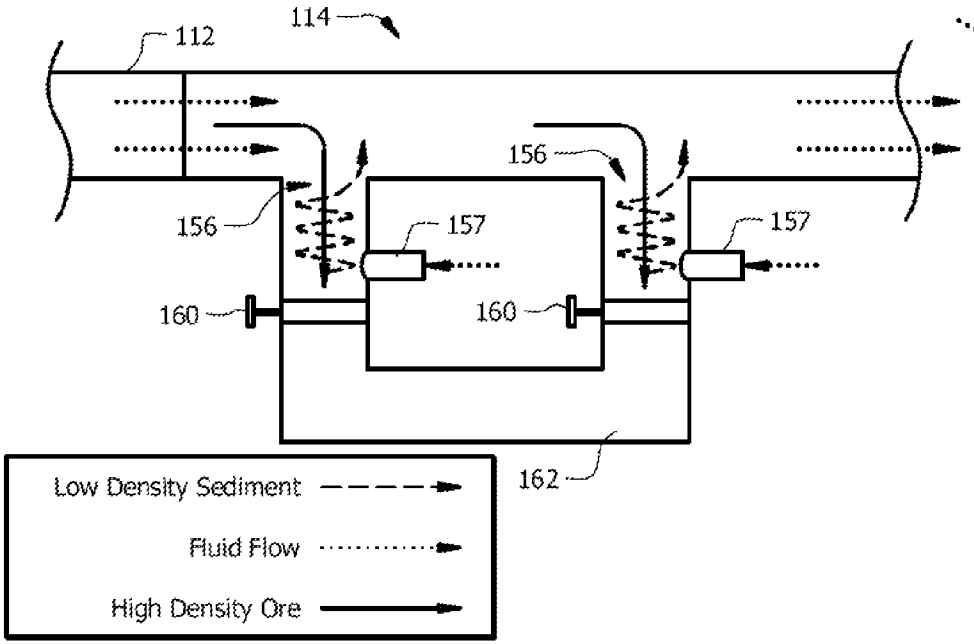
FIG. 12A provides an exemplary embodiment of the nugget trap.

As shown in FIG. 1, an embodiment of the mining system includes a four-stage classification and separation structure to improve efficiency. The four stages allow for the separation of various sizes of desired ore ranging from fine "flour pieces" to larger nuggets. The system may include an underwater dredge (not shown) that can be manhandled or attached to a remotely controlled vehicle. The dredge vacuums material from the substrate and discharges said material into trommel 102 through trommel intake 104. Trommel 102 filters the dredged material through trommel screen 120 as the material passes through trommel 102 towards trommel outlet 108. Trommel screen 120 increases in porosity starting from trommel intake 104 and moving towards trommel outlet 108. Trommel trough 103 collects the filtered material in four different sections 103A-D, where the first section collects the finest material and the last section collects the largest pieces as is exemplified in FIG. 10. Trough 103 is sectioned in accordance with the filtering sections of trommel screen 120 and aids dispensing the filtered material into one of three separators 110A-C. The oversized gravel that is too large to filter through the sections A-C is discharged from material outlet 112. In an embodiment, the oversized gravel passes into trap 114 as shown in FIG. 12, before or after being discharged from material outlet 112. Material outlet 112 is visible in FIGS. 9-11 and may have any form, such as the downpipe of FIG. 10 or simply the opening of FIGS. 9 and 11.

Figure 9:
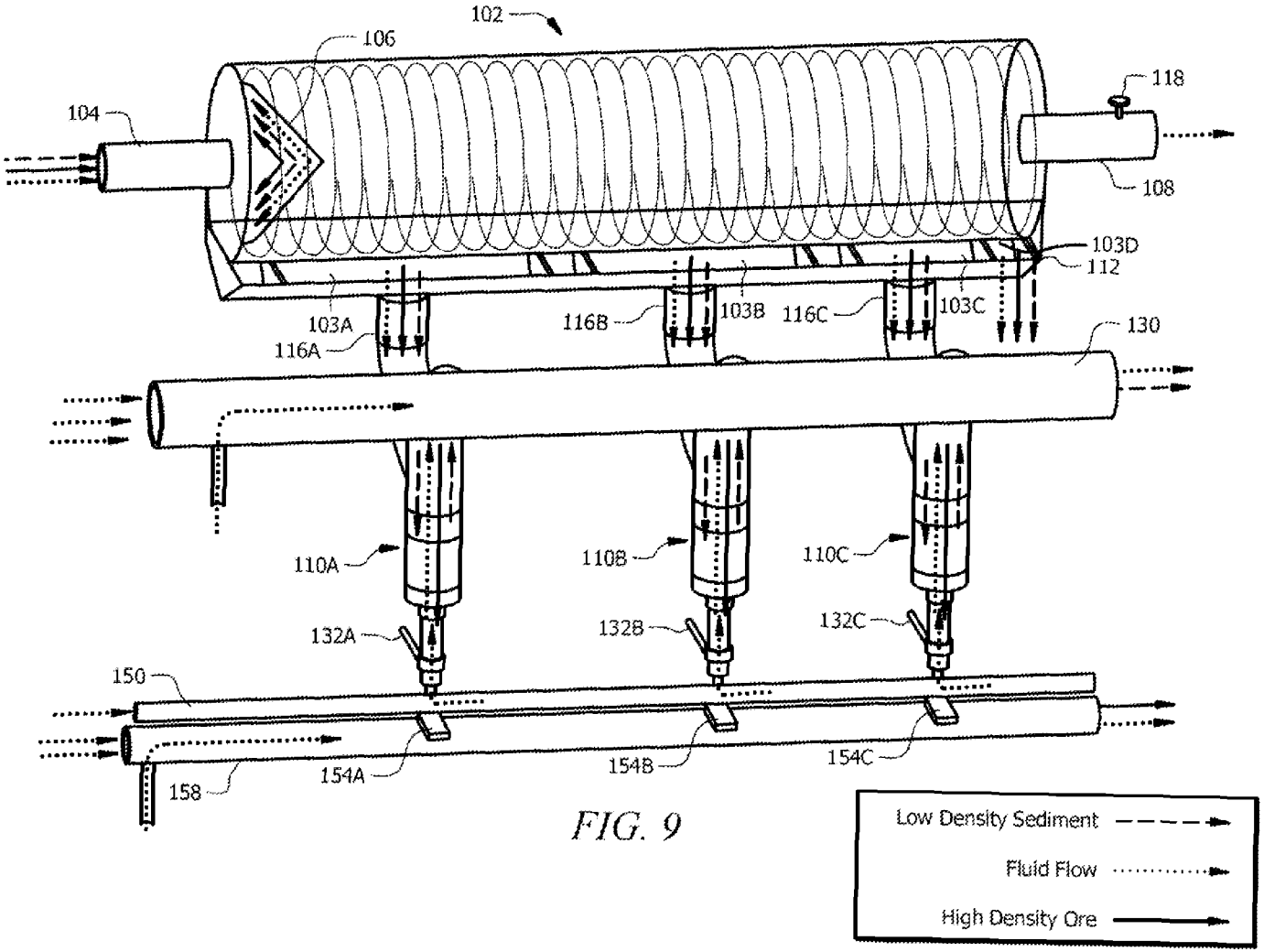
FIG. 9 is a perspective view of an embodiment of the present invention illustrating the operation of the system using flow arrows, wherein the dotted lines represent water flow, the solid lines represent ore movement, and the dashed lines represent the movement of unwanted sand and gravel.

The mixture of water and material from the dredge enters trommel intake 104 under high velocity and strikes deflector cone 106 as shown in FIG. 1 and further highlighted in FIG. 9. After striking the deflector cone 106, the velocity of the mixture rapidly reduces and the mixture begins passage through trommel 102. Trommel 102 and trommel trough 103 include five combined exit points, including three separator inlets 116A-C, material outlet 112, and trommel outlet 108. Trommel outlet 108 includes trommel valve 118 to control all outlet flows, which must be adjusted to optimize the flow and separation of the material through trommel 102. Trommel 102 and trommel trough 103 are encapsulated in a single contained system, but it is considered that the trough could simply be disposed beneath the trommel without being encapsulated with the trommel.

Figure 10:
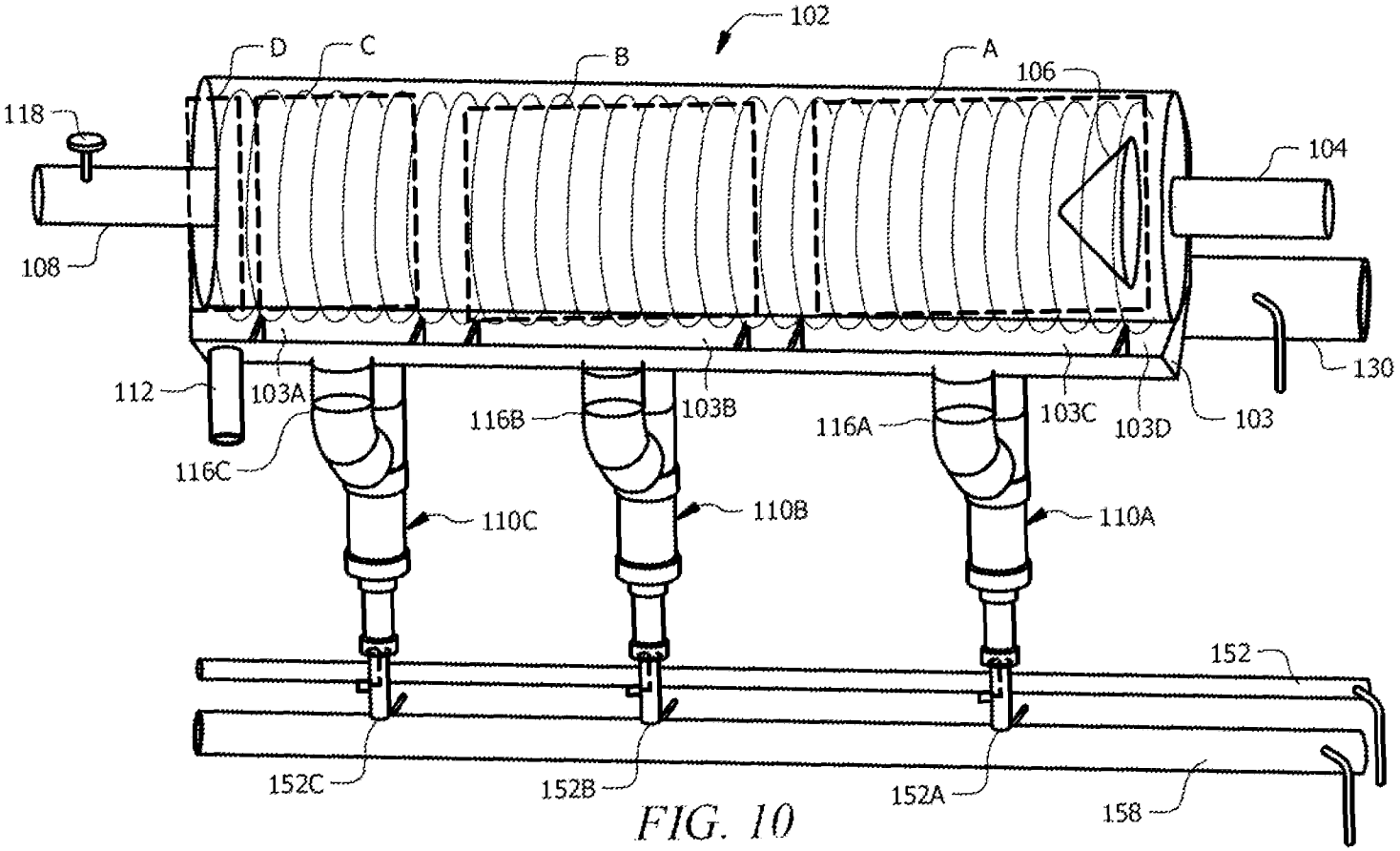
FIG. 10 is a rear view of an embodiment of the trommel, showing screen sections A, B, C in a slanted orientation.

In addition to trommel valve 118, the rotation of trommel 102 and its threaded interior help to transport the mixture of dredged material towards trommel outlet 108. In an embodiment, the trommel may be angled downward from inlet 104 to outlet 108 as illustrated in FIG. 10 to aid in the movement of material from the trommel inlet to the trommel outlet. It is also considered that an additional fluid source may be introduced through or near the trommel inlet to aid in the transportation of material through the trommel.

Trommel 102 includes trommel screen 120 with increasing porosity from inlet 104 towards trommel outlet 108. In an embodiment, trommel 102 may include a separator screen for each separating section (sections A-C), where each screen has greater porosity than the screen in the previous section. As the mixture begins passage through trommel 102, it first passes into separating section A where fine particles pass through trommel screen 120 in trommel 102. The particles that are too large to pass through trommel screen 120 in separator section A, move into section B of trommel 102. The trommel screen in section B is more porous than the screen of section A allowing it to filter particles larger than those filtered in section A. Similarly, the screen in section C filters particles larger than those filtered in section B and the screen in section D filters particles larger than those filtered in section C. In a certain embodiment, section D lacks a screen and simply allows all of the remaining material to drop into a corresponding section of the trommel trough. As the mixture of water and dredged material passes through trommel 102, sections A-D filter material from the mixture. An exemplary embodiment includes section A having a screen with mesh holes of about 1/16" in diameter, section B having a screen with mesh holes of about 1/8" in diameter, and section C having a screen with mesh holes of about 1/4" in diameter. The dredge inlet includes a screen having mesh holes of about 1/2" in diameter. Any material between 1/4" and 1/2" passes to section D where nugget trap 114, as shown in FIG. 12, provides further separation of desired ore from unwanted sediment.

Figure 2:
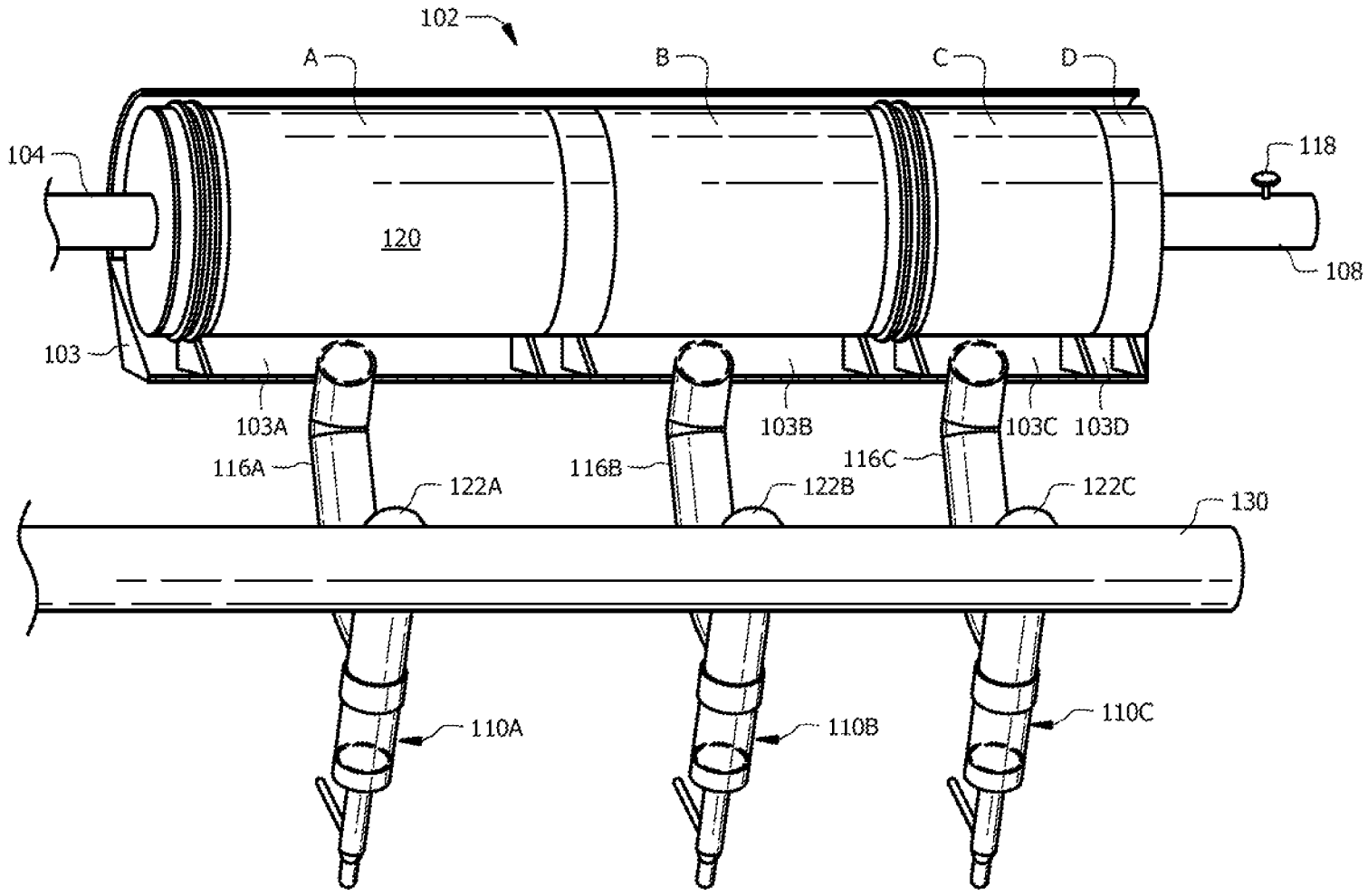
FIG. 2 is a front top view of the system in FIG. 1 showing the different sections of the trommel screen and trommel trough attached to each separator.
Figure 3:
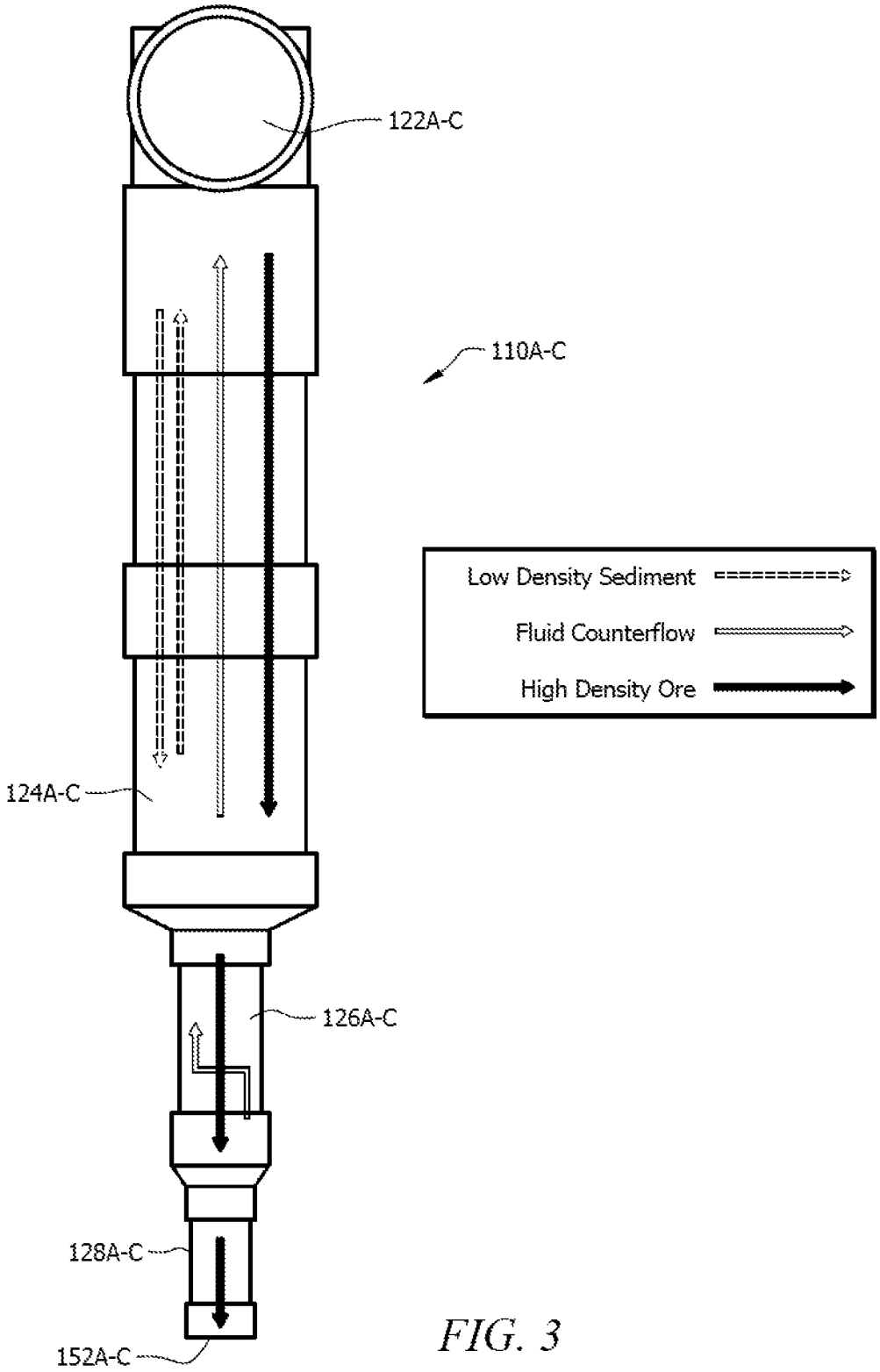
FIG. 3 is an isolation view of an embodiment of a separator and its three sections highlighting the flow of fluid, low-density sediment, and high-density ore.
Figure 4:
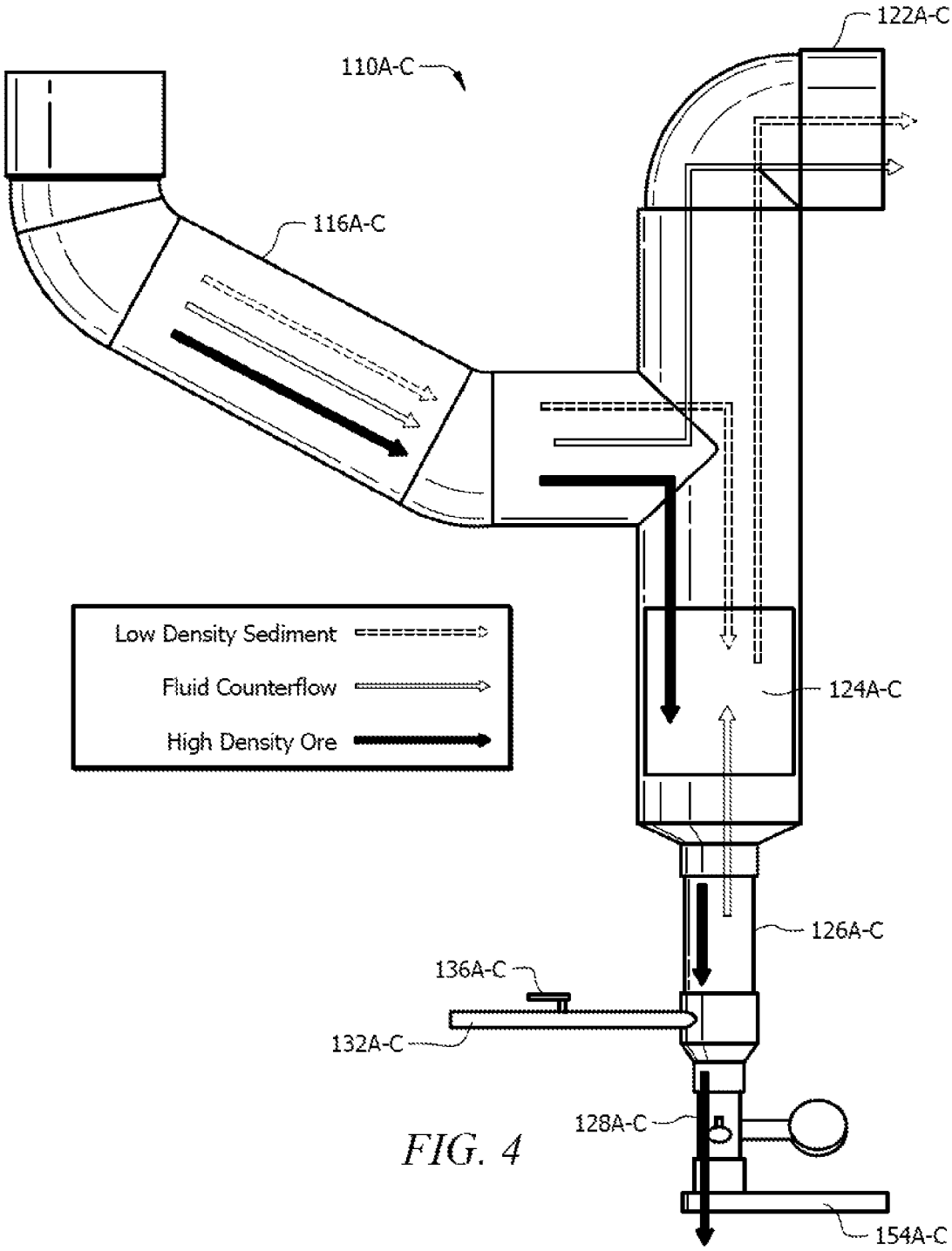
FIG. 4 is a side view of FIG. 3.

The particles filtered in sections A-C drop into corresponding sections 103A-C of trommel trough 103 and funnel into separators 110A-C as shown in FIG. 9. As shown in FIG. 2, there is an independent separator 110 for trommel sections A-C, where separator 110A separates "fine" material, separator 110B separates medium-sized material, and 110C separates larger material. Separators 110A-C are each specifically tuned to separator the desired ore from the material funneled into the separator. As shown in FIGS. 3 and 4, each separator comprises of three separation chambers, separator inlet 116 A-C (from trommel 102), and separator outlet 122A-C to flush any unwanted sediment into exhaust tube 130. The three chambers include initial separation chamber 124A-C, secondary separation chamber 126A-C, and final separation chamber 128A-C.

The mixture of material and water that funnels into separator inlet 116A-C from trommel 102 and trommel trough 103 first encounters initial separation chamber 124A-C. A vertical fluid counter-flow, originating from secondary separation chamber 126A-C, forces the undesired sediment back out of initial separation chamber 124A-C and into exhaust tube 130, while allowing the desired ore to sink into secondary separation chamber 126A-C. The counter-flow is tunable so that the resultant force imposed on the material will discharge lightweight sediment and allow the greater density/specific gravity ore to sink through the initial separation chamber and into the secondary separation chamber. The undesired sediment either is forced out of initial separation chamber 124A-C through separator outlet 122A-C or falls into a suspension-like flow, depending on the density of the sediment. Heavier ore and sediment sinks through the counter-flow and enters secondary separation chamber 126A-C. Any sediment that passes into secondary separation chamber 126A-C and has a lower density/specific gravity than the ore is forced into a suspension-like flow pattern in secondary separation chamber 126A-C.

Figure 5:
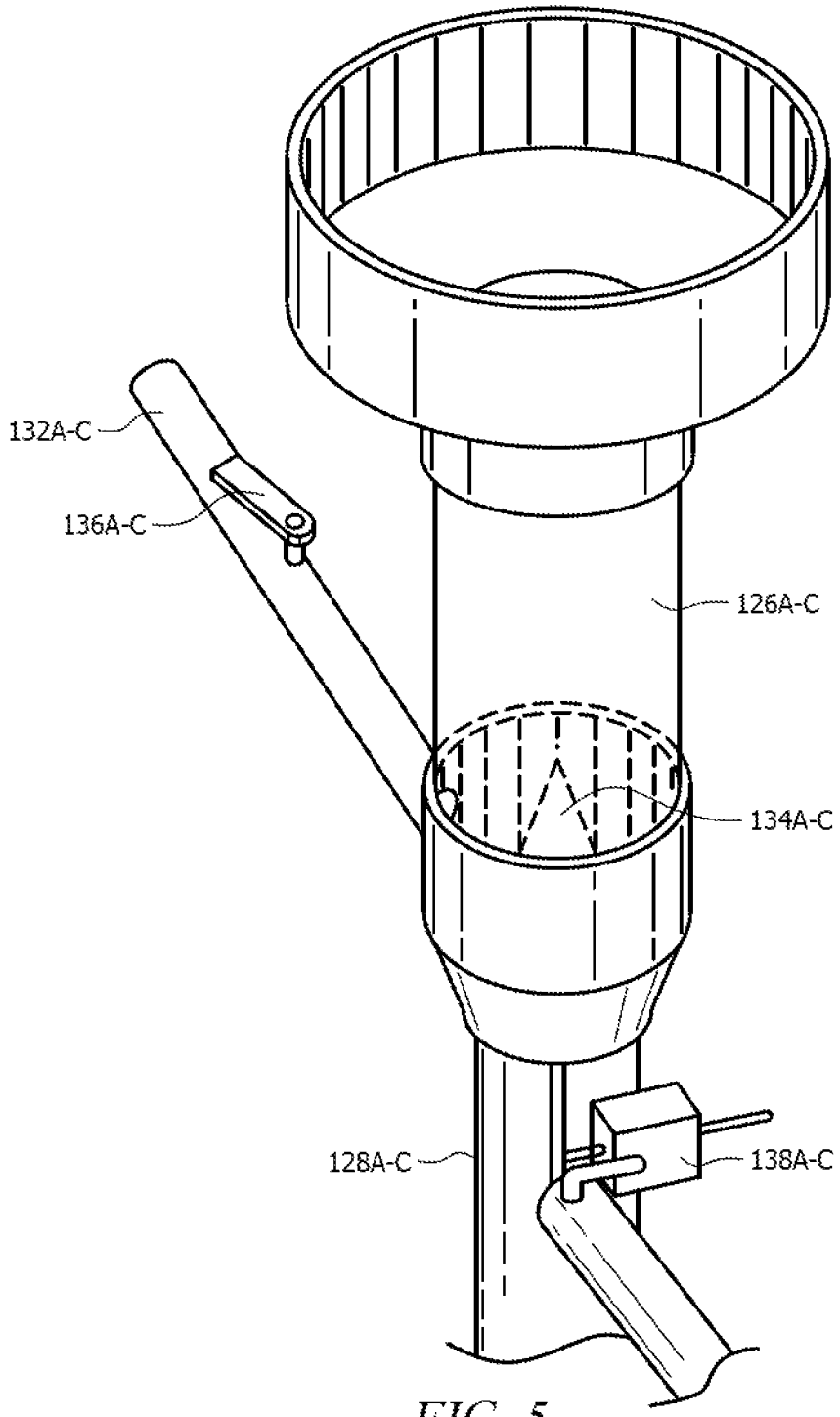
FIG. 5 is an isolation view of secondary separation chamber of an exemplary separator.
Figure 6:
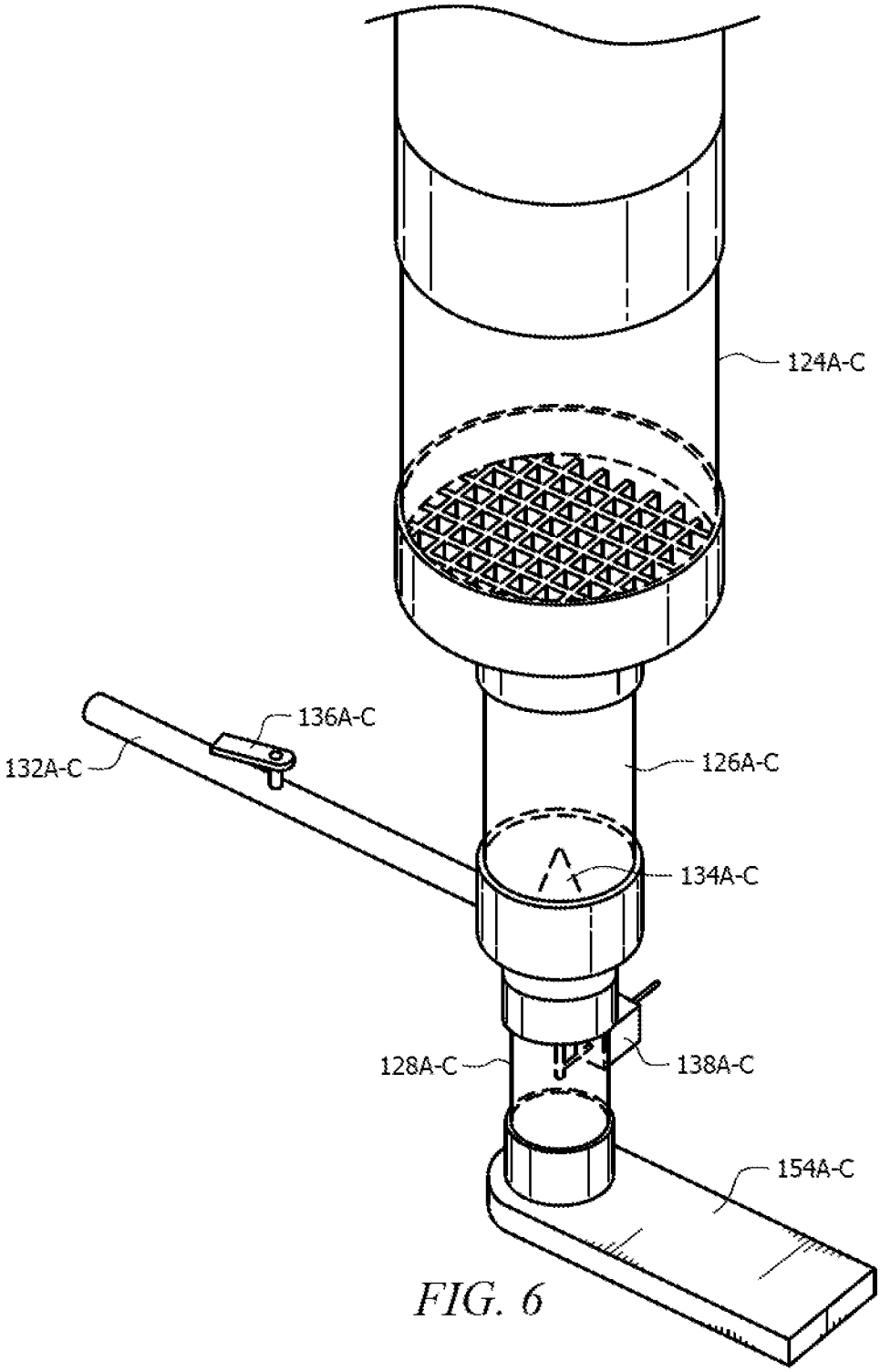
FIG. 6 is an isolation view of secondary separation chamber and the final separation chamber of an exemplary separator.

As shown in FIGS. 5-6, secondary separation chamber 126A-C includes vortex jet inlet 132A-C. Vortex jet inlet 132A-C is angled with respect to the central longitudinal axis of secondary separation chamber 126A-C to create a vortex flow in secondary separation chamber 126A-C. The vortex flow forces the heavier material against the wall and downward towards plunger valve 134A-C. In addition, the vortex flow captures the lighter sediment in the vortex and forces the lighter sediment upwards. In an embodiment, separator inlet 116A-C is set on a pulse flow to accelerate and push the lighter sediment into suspension. This pulse is adjustable depending on the different parameters. Vortex inlet 132A-C is in communication with a fluid source and includes vortex inlet valve 136A-C to adjust the flow rate.

As show in FIG. 6, an embodiment of separator 110A-C includes grate 140A-C located between initial separation chamber 124A-C and secondary separation chamber 126A-C. Grate 140A-C converts the vortex flow from secondary separation chamber 126A-C into a straight or slight rotation flow as the flow transitions into initial separation chamber 124A-C. Thus, only a single fluid source is required to create the counter-flows in both the initial and secondary separation chamber. It is considered that both chambers can include one or more fluid inlets/fluid sources to create the counter-flows.

Figure 7:
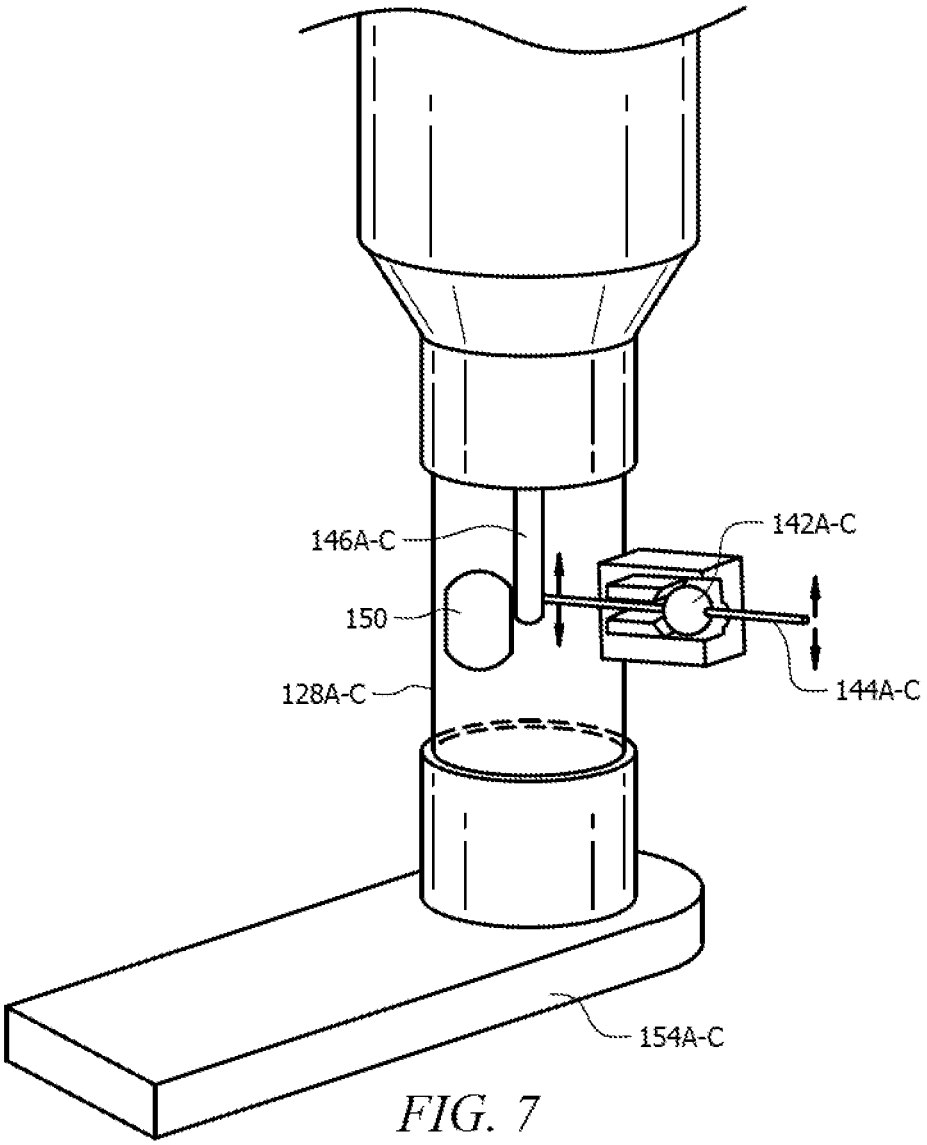
FIG. 7 is a close-up view of the final separation chamber and a cross-sectional view of an exemplary plunger valve assembly.
Figure 8:
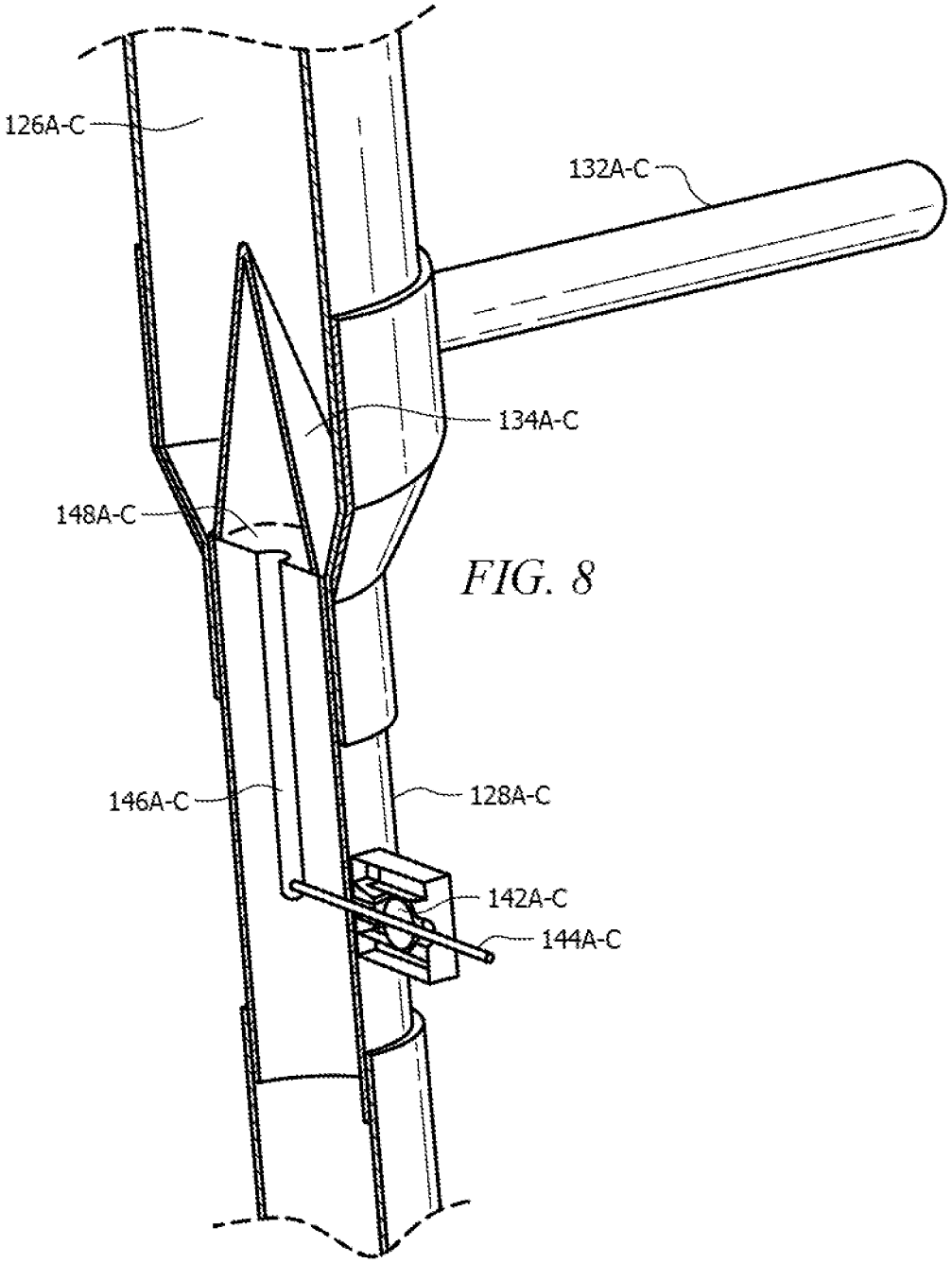
FIG. 8 is a cross-sectional view of an exemplary separator illustrating the plunger design.

As shown in FIGS. 5, 6, and 8, plunger valve 134A-C is located in secondary separation chamber 126A-C and is preferably cone shaped to aid in the creation of the vortex flow. As shown in FIGS. 7 and 8, plunger valve 134A-C is controlled via plunger actuator 138A-C, which is adapted to translate plunger valve 134A-C in the vertical direction. Vertical translation of plunger valve 134A-C allows plunger valve 134A-C to transition between a closed position and an open position. In the closed position, plunger valve 134A-C prevents passage of fluid and material from secondary separation chamber 126A-C into final separation chamber 128A-C. In the open position, plunger valve 134A-C allows passage of the collected desired ore from secondary separation chamber 126A-C into final separation chamber 128A-C.

In an embodiment, as shown in FIGS. 7 and 8, plunger actuator 138A-C includes plunger level 144A-C attached to rotule 142A-C and to plunger rod 146A-C. Plunger rod 146A-C is also attached to base 148A-C. Thus, manipulation of plunger level 144A-C results in the translation of plunger rod 146A-C and attached base 148A-C in the vertical direction. In a certain embodiment, the plunger valve may be operated by any mechanism known to a person having ordinary skill in the art that is adapted to move the plunger valve between an opened and closed position. In addition, the plunger valve can be left open to continuously collect heavier sediment or closed to collect batches; however, the plunger valve needs to be closed when the bottom valve of the final chamber is open. In an embodiment, plunger valve 134A-C also includes the ability to move the vortex flow up towards initial separation chamber 124A-C.

The heavier sediment, ideally only desired ore, drops to the bottom of final separation chamber 128A-C when plunger valve 134A-C is in the open position. As shown in FIG. 7, final separation chamber 128A-C includes flush inlet 151A-C that connects to flush assembly 150. Flush assembly 150, and flush inlet 151A-C, use fluid-flow and pressure to clean separators 110A-C, which is illustrated in FIGS. 9 and 11. Final separation chamber 128A-C may be equipped with an electric, magnetic, or other detector to determine when final separation chamber 128A-C needs to be flushed. Flush assembly 150 is preferably fluidly coupled to a fluid source and each separator as shown in FIGS. 9-11.

The high density/specific gravity ore collected in final separation chamber 128A-C exits through collection outlet 152A-C located at the bottom of final separation chamber 128A-C as shown in FIG. 4. Collection outlet 152A-C includes an open and closed position controlled by bottom valve 154A-C. When bottom valve 154A-C is opened, the high-density material passes into collection tube 158 as shown in FIGS. 9-11, which is in communication with a fluid source to create a flow capable of moving the heavy sediment to a collection area. At the same time, the flow in collection tube 158 creates a vacuum in final separation chamber 128A-C when bottom valve 154A-C is open.

Each separator works on the same principal, but with a different flow rate adapted to optimize the separation of different sized sediment and ore. In a certain embodiment, each separator is of different size adjusted based on the size and density of the ore to be recover in that particular separator.

Material outlet 11, fluidly coupled to section D of trommel 102, may include one or more nugget traps 114 as shown in FIG. 12. Each trap 114 includes at least one floor opening 156 allowing nuggets to drop into a trap vortex flow produced from an off-center fluid inlet 157. The vortex maintains fluidity of the falling gravel while also pushing lighter gravel out of the trap. Each trap is under a magnetic pulse field, or similar detection device, to detect any nuggets. When a nugget is detected, trap valve 160 opens to collect the nugget in nugget housing 162. In an embodiment, the nugget trap is fluidly coupled to collection tube 158 to combine the collected ore. In an embodiment, collection tube 158 is coupled to one or more ore collectors that are adapted to separate from the collection tube and float to the surface of the body of water. In a certain embodiment, nugget housing 162 is also capable of separating and floating to the surface of the body of water.

The system may include water flow sensors, ore detectors, and control computers for providing a nearly autonomous mining system. In an embodiment, the separator includes a 24" long initial separation chamber 124A-C with a 6" inner diameter, a 12" long secondary separation chamber 126A-C with a 4" inner diameter, and a 6" long final separation chamber 128A-C with a 2" inner diameter. In an embodiment, the vortex jet flow rate is between 30 and 50 GPM. In an embodiment, the flow rate of trommel inlet 104 is 1400 GPM for a 6" diameter inlet and contains 10-12% sediment to produce 60-80 tons of sediment/hr and about 25-30 cubic yards/hr.

GLOSSARY OF CLAIM TERMS

Trommel: is a screened cylinder used to separate material.

Fluid Counter-flow: is a flow of fluid in a direction opposing the initial direction of travel of lightweight material entering the separation chamber.

Vortex Fluid Flow: is a circular flow pattern.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A mining system, comprising:

a trommel having a trommel inlet and a trommel outlet with a trommel screen disposed between the trommel inlet and trommel outlet;

a trommel trough located beneath the trommel for collecting material that filters through the trommel screen;

the trommel trough attached to a first separator through a first separator inlet, such that the material collected in the trommel trough funnels into the first separator inlet;

the first separator further including:

an initial separation chamber having a fluid counter-flow imposing a force on the material funneled into the first separator, wherein the force is less than the weight of a desired ore and greater than the weight of surrounding sediment;

a first separator outlet fluidly coupled to the initial separation chamber such that the first separator outlet receives the surrounding sediment that is forced upwards by the fluid counter-flow;

a secondary separation chamber fluidly coupled to the initial separation chamber to receive any material that passes through the initial separation chamber;

a vortex inlet fluidly coupled to the secondary separation chamber, wherein the vortex inlet creates a vortex fluid flow in the secondary separation chamber that imposes a force on any material in the secondary separation chamber to collect undesired sediment in the vortex fluid flow while allowing desired ore to escape the vortex fluid flow based on the weight of the desired ore and the weight of the undesired sediment;

a plunger valve located at a bottom end of the secondary separation chamber, wherein the plunger valve can transition between an open position and a closed position;

the open position allowing the desired ore to pass into a final separation chamber fluidly coupled to the secondary separation chamber and the closed position preventing passage of the desired ore into the final separation chamber; and the final separation chamber including a bottom valve having an open position and a closed position, wherein the bottom valve allows the desired ore to pass through a collection outlet when the bottom valve is in the open position and prevent the desired ore from passing through the collection outlet when the bottom valve is in the closed position.

2. The mining system of claim 1, further including a deflector cone located near the trommel inlet such that a dredged mixture strikes the deflector cone after passage through the trommel inlet.

3. The mining system of claim 1, further comprising:

the trommel screen including a first section and a second section, wherein the first section is near the trommel inlet, the second section is nearer the trommel outlet, and the second section has greater porosity than the first section such that larger material filters through the second section than the first section;

the trommel trough including a first section and a second, wherein the first section of the trommel trough is positioned beneath the first section of the trommel screen and the second section of the trommel trough is positioned beneath the second section of the trommel screen; and the first separator fluidly coupled to the first section of the trommel trough and a second separator fluidly coupled to the second section of the trommel trough.

4. The mining system of claim 1, wherein the plunger valve has a conical shape with a tip extending upwards into the secondary separation chamber.

5. The mining system of claim 1, further comprising a grate between the initial separation chamber and the secondary separation chamber, wherein the grate is adapted to reduce the vortex fluid flow from the secondary separation chamber when the flow passes from the secondary separation chamber into the initial separation chamber.

6. The mining system of claim 1, wherein the vortex inlet further includes a valve adapted to adjust flow rate.

7. The mining system of claim 1, further comprising a flush assembly fluidly connected to the final separation chamber with a valve between the flush assembly and the final separation chamber, the flush assembly adapted to force sediment in the separator upwards and out of the separator outlet.

8. The mining system of claim 1, further including a collection tube fluidly coupled to the first and second separators.

9. The mining system of claim 1, further comprising a nugget trap near the trommel outlet, wherein the nugget trap includes a floor opening leading to a gate valve, the gate valve adapted to open upon detection of a nugget to secure the nugget in a nugget housing.

10. The mining system of claim 9, wherein the nugget trap includes a fluid inlet between the floor opening and the gate valve, adapted to create a vortex-like flow pattern.

11. The mining system of claim 1, wherein the trommel outlet includes a trommel valve adapted to adjust the flow rate through the trommel.

* * * * *